US010122075B2

(12) United States Patent
Lankes et al.

(10) Patent No.: US 10,122,075 B2
(45) Date of Patent: Nov. 6, 2018

(54) ANTENNA SYSTEM

(71) Applicant: KATHREIN-WERKE KG, Rosenheim (DE)

(72) Inventors: Thomas Lankes, Rosenheim (DE); Frank Mierke, Unterhaching (DE); Adrian Sigg, Grafing (DE)

(73) Assignee: Kathrein-Werke KG, Rosenheim (DE)

( * ) Notice: Subject to any disclaimer, the term of this patent is extended or adjusted under 35 U.S.C. 154(b) by 331 days.

(21) Appl. No.: 14/940,671

(22) Filed: Nov. 13, 2015

(65) Prior Publication Data

US 2016/0141750 A1 May 19, 2016

(30) Foreign Application Priority Data

Nov. 13, 2014 (DE) ..... 10 2014 016 851

(51) Int. Cl.

| | |
|---|---|
| ***H01Q 1/38*** | (2006.01) |
| ***H01Q 13/10*** | (2006.01) |
| ***H01Q 1/32*** | (2006.01) |
| ***H01Q 1/52*** | (2006.01) |
| ***H01Q 21/06*** | (2006.01) |
| ***H01Q 1/50*** | (2006.01) |

(52) U.S. Cl.

CPC ..... *H01Q 1/38* (2013.01); *H01Q 1/3275* (2013.01); *H01Q 1/50* (2013.01); *H01Q 1/521* (2013.01); *H01Q 13/10* (2013.01); *H01Q 21/06* (2013.01)

(58) Field of Classification Search

CPC ..... H01Q 1/38

USPC ..... 343/865

See application file for complete search history.

(56) References Cited

U.S. PATENT DOCUMENTS

| | | | | |
|---|---|---|---|---|
| 4,866,453 | A * | 9/1989 | Nagy | H01Q 1/3275 343/712 |
| 2005/0116873 | A1* | 6/2005 | Soler Castany | H01Q 1/38 343/795 |
| 2006/0244674 | A1* | 11/2006 | Schantz | H01Q 1/38 343/795 |

FOREIGN PATENT DOCUMENTS

| | | |
|---|---|---|
| DE | 100 25 931 | 8/2001 |
| JP | 8-18333 | 1/1996 |

* cited by examiner

*Primary Examiner* — Andrea Lindgren Baltzell
(74) *Attorney, Agent, or Firm* — Nixon & Vanderhye P.C.

(57) ABSTRACT

An antenna system for motor vehicles includes a surface that comprises an electrically conductive medium. A recess is located inside the electrically conductive surface, with the electrically conductive surface being a periphery of the recess. At least one electrically conductive crosspiece is electrically conductively connected to the periphery and protrudes into the recess and extends in the direction of a second side, facing the first side, of the periphery and there ends, forming a gap with the periphery. This crosspiece divides the recess into first and second parts with a gap connecting the two parts. At least one electrical line in a part of the recess originates at a feed point, located on the crosspiece but is electrically separate from it. The electrical line extends in the part of the recess in the direction of the periphery and is capacitively coupled to the periphery.

23 Claims, 5 Drawing Sheets

ANTENNA SYSTEM

Figure 1:
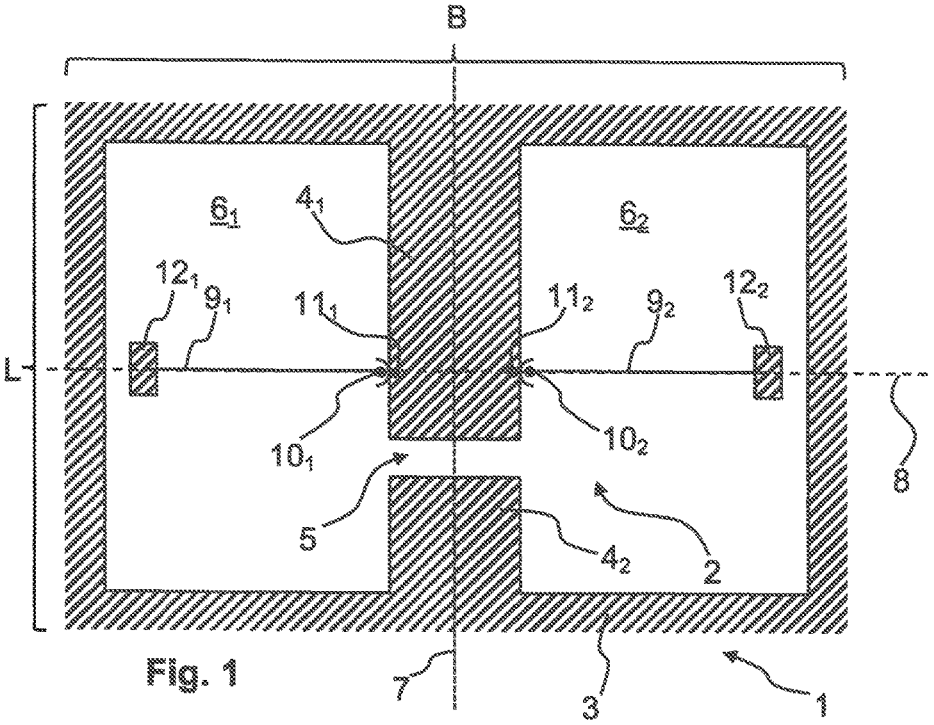

This application and claims priority to DE Patent Application No. 10 2014 016 851.4 filed 13 Nov. 2014, the entire contents of which is hereby incorporated by reference.

The invention relates to a MIMO (Multiple Input Multiple Output) slot antenna, which can be used in particular for motor vehicles.

Because of reflections of the received signal during vehicle travel, which are caused for instance by nearby buildings, the reception quality of the antenna mounted in the vehicle changes constantly. There has accordingly been a shift to using a plurality of antennas, which should be de-correlated as well as possible; the received signals are combined in such a way that the reception quality is improved compared to a single antenna.

From German Patent Disclosure DE 100 25 931 A1, an antenna module is known that has a periphery on which two crosspieces extend toward one another. Inside the recess that is bounded by the periphery, various further antenna structures are installed, in order to make many services, which employ different frequencies, usable.

A disadvantage of DE 100 25 931 A1 is that because of the many individual antenna elements, production is complicated and expensive, and the available antenna diversity for low frequencies (in this case FM radio) is poor.

It is therefore the object of the present invention to create an antenna system which in a simple way furnishes at least two de-correlated antennas, which offer very great diversity.

This object is attained by independent claim 1. Advantageous refinements of the invention are found in the dependent claims. The subject of claim 20 is a trunk lid that has the antenna system of the invention. In claim 21, a passenger car equipped with such a trunk lid is described.

According to independent claim 1, the antenna system has a surface which comprises an electrically conductive medium. A recess is located inside the electrically conductive surface, and as a result the electrically conductive surface acts as a periphery of the recess. Moreover, the antenna system has at least one electrically conductive crosspiece, which originates on a first side of the periphery and is electrically conductively connected to it, that is, to the periphery, and protrudes into the recess and extends in the direction of a second side, facing the first, of the periphery and ends there, forming a gap with this periphery, as a result of which the recess is made up of a first part, a second part, and the gap connecting the two parts, or in other words is divided. Moreover, for this purpose, the antenna system includes at least two electrical lines, of which a first electrical line originates in the first part of the recess at a first feed point, located on the first crosspiece but electrically separate from it, and a second electrical line, which originates in the second part of the recess at a second feed point located on the first crosspiece but electrically separate from it. The first electrical line extends in the first part of the recess in the direction of the periphery and is capacitively coupled, for instance by its end, to the periphery. The same is true for the second electrical line, which extends in the second part of the recess in the direction of the periphery and is capacitively coupled, for instance by its end, to the periphery.

Given suitably correct-phase feeding, two orthogonal resonance modes can be excited. The slot antenna of the invention can therefore be compared with two physically separate antennas.

In the antenna system of the invention, it is also an advantage if at least one second electrically conductive crosspiece is embodied, which originates at the second side of the periphery and is connected electrically conductively to the periphery and protrudes into the recess and in it tapers to a point toward the first crosspiece, and both crosspieces end there, forming the gap from one another. Because the two crosspieces are oriented axially, preferably coaxially, to one another, and are preferably diametrically opposite one another, thereby forming the gap, a high degree of de-correlation between the antennas is achieved.

Moreover, in the antenna system of the invention it is an advantage if the first electrical line, via its end, and the second electrical line, via its end, are capacitively coupled to the periphery by means of a distributed coupling capacitor and/or a discrete capacitor. The resonant frequency of the antenna system can be adjusted via this kind of distributed coupling capacitor, which is preferably an electrically conductive surface, e electrically separate from the periphery and located on the same plane or the same dielectric medium on which the first and/or second electrical line is also located; or a discrete capacitor, which is a normal capacitor or a variable-frequency capacitor, such as a PIN diode; or surfaces or discrete capacitors that can be hooked up by means of MEMS (microelectromechanical systems). The "end" means the part of the first and second electrical line, that is, the end, that is farthest away from the feed point. In the event that a discrete capacitor is employed, it can also be mounted on the end of the first and second electrical line that is located closer to the respective feed point.

In addition, it is an advantage in the antenna system of the invention if the distributed coupling capacitor and/or the discrete capacitor is located less than the distributed coupling capacitor ($\mathbf{12}_1$, $\mathbf{12}_2$) and/or the discrete capacitor ($\mathbf{13}_1$, $\mathbf{13}_2$) is located less than $\lambda/5$, preferably less than $\lambda/10$, more preferably less than $\lambda/15$, more preferably less than $\lambda/20$ or less than $\lambda/50$, more preferably less than $\lambda/100$, more preferably less than $\lambda/500$ or more preferably less than $\lambda/1000$ of the highest frequency of the transmitted frequency band away from the periphery.

Moreover, in the antenna system of the invention it is an advantage if at least one inductance is embodied in the first electrical line and/or in the second electrical line. An inductance like this has the effect that the resonant frequency of both resonance modes can be varied.

It is moreover an advantage in the antenna system of the invention if the first and the second crosspiece are connected to one another via at least one further discrete capacitor and/or via at least one further discrete inductance; the at least one further discrete capacitor and/or the at least one further discrete inductance is located, or in other words embodied, inside the gap. As a result, only the resonant frequency of a resonance mode (common-mode excitation) can be varied.

It is furthermore an advantage in the antenna system of the invention if the first feed point is connectable or connected to a first gate of a feeder device and if the second feed point is connectable or connected to a second gate of the feeder device; the feeder device supplies the first and second feed points with a common-mode signal and/or a push-pull signal. By means of the symmetrical common-mode signal and/or the symmetrical push-pull signal, the two different modes can be excited. Feeding by means of a common-mode signal and/or a push-pull signal is also very simply possible by using a hybrid coupler, in particular a 180° hybrid coupler, or an HF transformer with appropriate wiring, for example, for the feeder device.

It is furthermore an advantage if in the antenna system of the invention the first feed point is electrically connectable or connected to an inner conductor of a first coaxial cable or to a conductor of a first printed line, and/or if the second feed point is electrically connectable or connected to an inner conductor of a second coaxial cable or to a conductor of a second printed line. A printed line can for instance be microstrip lines or coplanar strip lines, or strip lines, or slot lines. The effect is that the antenna system can be supplied quite simply.

It is furthermore an advantage if, in the antenna system of the invention, an outer conductor of the first coaxial cable or a ground face of the first printed line is electrically connectable or connected to the first crosspiece via a first ground terminal contact on the first crosspiece, and/or if an outer conductor of the second coaxial cable or a ground face of the second printed line is electrically connectable or connected to the second crosspiece via a second ground terminal contact on the second crosspiece. This ensures that the antenna system designed as a slot antenna is excited as efficiently as possible and that the two resonance modes are orthogonal to one another.

Moreover, in the antenna system of the invention, it is an advantage if the spacing between the first feed point and the first ground terminal contact is less than λ/100 or preferably less than λ/500 or more preferably less than λ/1000 of the highest frequency of the transmitted frequency band, and/or if the spacing between the second feed point and the second ground terminal contact is less than λ/100 or preferably less than λ/500 or more preferably less than λ/1000 of the highest frequency of the transmitted frequency band. This ensures that the antenna system is optimally excited.

In addition, in the antenna system of the invention, it is an advantage if the first feed point and/or the second feed point is located less than λ/5, preferably less than λ/10, more preferably less than λ/15, more preferably less than λ/20, more preferably less than λ/50, more preferably less than λ/100, more preferably less than λ/500 or more preferably less than λ/1000 of the highest frequency of the transmitted frequency band away from the gap. This may involve the distance between the feed point and the middle of the gap, that is, the middle of the rectangular gap surface relative to the length and width of the gap. However, it can also involve the shortest distance between the feed point and one corner of the first crosspiece that is adconnected by the gap.

This ensures that the antenna system is excited quite well. The gap here should have the smallest possible width and be narrower than λ/5, preferably narrower than λ/10, more preferably narrower than λ/15, more preferably narrower than λ/20, more preferably narrower than λ/50, more preferably narrower than λ/100, more preferably narrower than λ/500 or more preferably narrower than λ/1000 of the highest frequency of the transmitted frequency band; the length of the gap is equivalent to the spacing of the two crosspieces from one another and/or to the spacing of the first crosspiece from the second side of the periphery.

Furthermore, in the antenna system of the invention it is an advantage if the first part of the recess and the second part of the recess are of equal size, or if the first part of the recess is larger than the second part of the recess, or if the first part of the recess is smaller than the second part of the recess. In particular if the surfaces of the first and second part of the recess are of equal size, symmetry exists, and the diversity of the antenna system of the invention is very great. The first part of the recess and the second part of the recess are in particular of equal size whenever they have both the same length and the same width. In the event that the first part of the recess has a length that is less than the length of the second part of the recess, while at the same time the width of the first part is greater than the width of the second part of the recess, so that nevertheless the result is a surface of equal size, the antenna system created thereby is not quite as good with regard to its de-correlation than if both the first part of the recess and the second part of the recess were to have the same length and the same width.

Moreover, in the antenna system of the invention it is an advantage if the first electrical line and/or the second electrical line extends orthogonally to the first crosspiece, or that the first electrical line and/or the second electrical line are at an angle from the first crosspiece that is between 60° and 120°, preferably between 70° and 110°, and more preferably between 80° and 100°, and more preferably between 85° and 95°.

In addition, in the antenna system of the invention, it is an advantage if the first electrical line and/or the second electrical line is formed as a conductor track on a dielectric, or that the first electrical line and/or the second electrical line is embodied as a cable or wire. Highly replicable properties are achieved whenever both lines are embodied on a dielectric medium, such as a printed circuit board or a foil. In the event that both electrical lines are embodied as a cable or wire, a very simple layout of the antenna system can be achieved. Then the metal periphery, like the first crosspiece and the second crosspiece of the antenna system, has be equally little need to be embodied on a solid dielectric medium.

In addition, in the antenna system of the invention, it is an advantage if the first crosspiece is located in a first plane and the second crosspiece is located in a second plane, and the two planes meet one another at an angle of 80° to 280°, preferably 80° to 200°, more preferably 85° to 150°, more preferably 85° to 120°, more preferably 85° to 95°. Such an antenna system can also preferably be integrated into passenger cars, in particular into the trunk lid.

The antenna system of the invention has such a trunk lid, and there is a particular advantage if the trunk lid, in the vicinity of the recess of the antenna system, comprises a dielectric material or covers the recess with dielectric material.

Finally, it is also possible that a passenger car has the aforementioned trunk lid, and the trunk lid contains the antenna element of the invention. The first crosspiece, at which the first and second electrical lines originate, is preferably located approximately parallel to the surface of the roadway. The first crosspiece can also preferably be tilted by less than 5° or less than 10° or less than 15° or less than 20° relative to the surface of the roadway. Integrating an antenna system in the trunk lid is more favorable than integrating it into the rear window of the passenger car, because this can be done in a way that encompasses multiple variants. Particularly the many kinds of different rear windows for various vehicles makes such integration very complicated and expensive. Especially in convertibles, additional problems arise because the rear window can be folded in with the convertible top.

Figure 2:
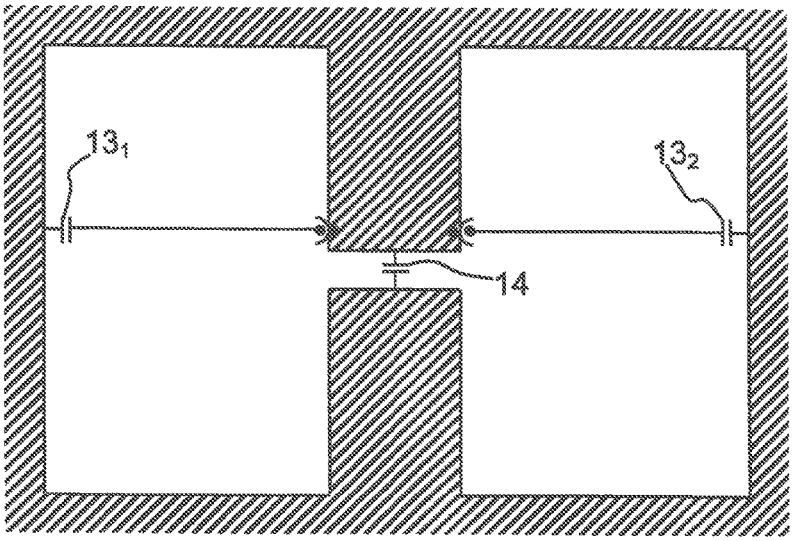
Figure 3:
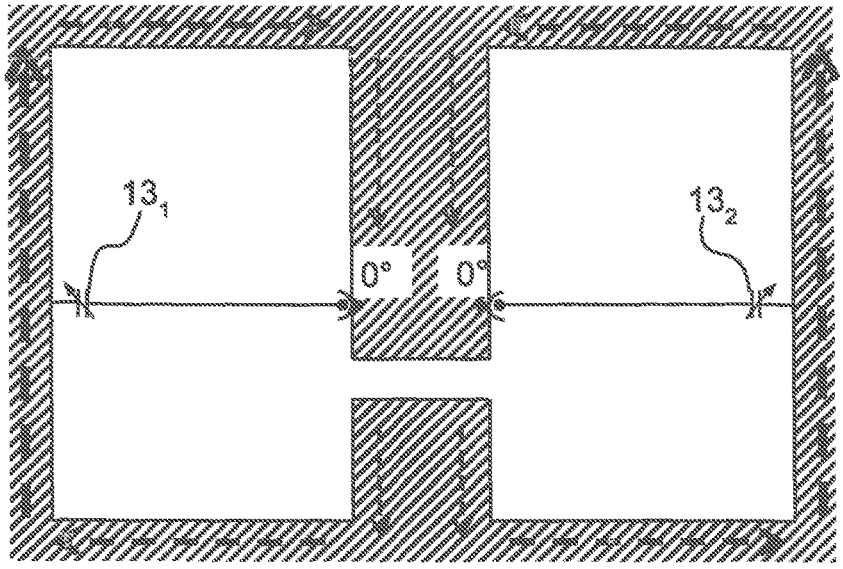
Figure 4:
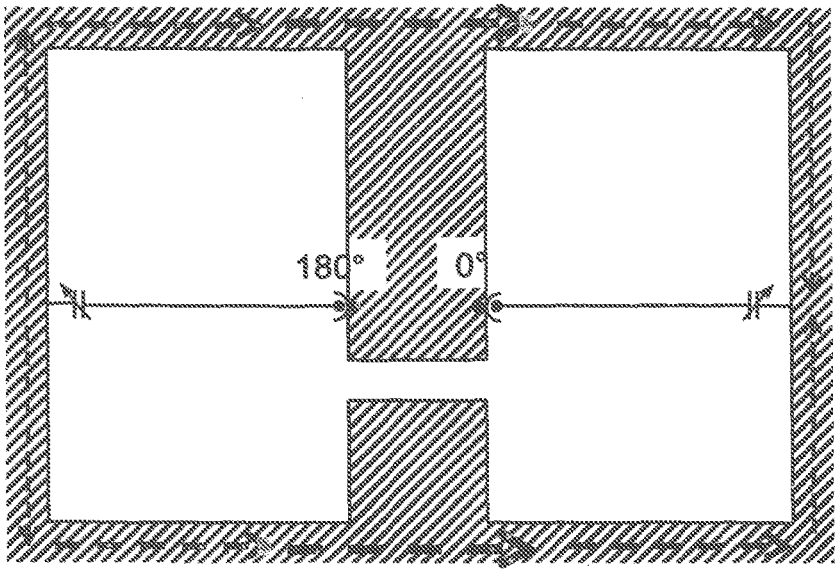
Figure 5:
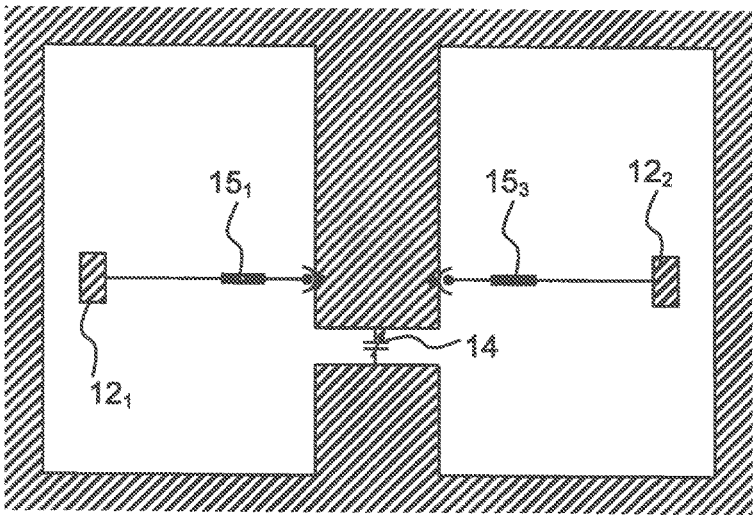
Figure 6:
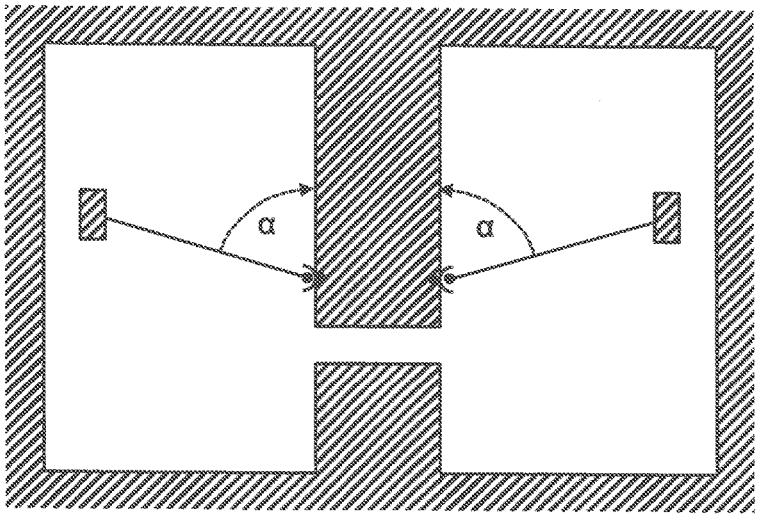
Figure 7:
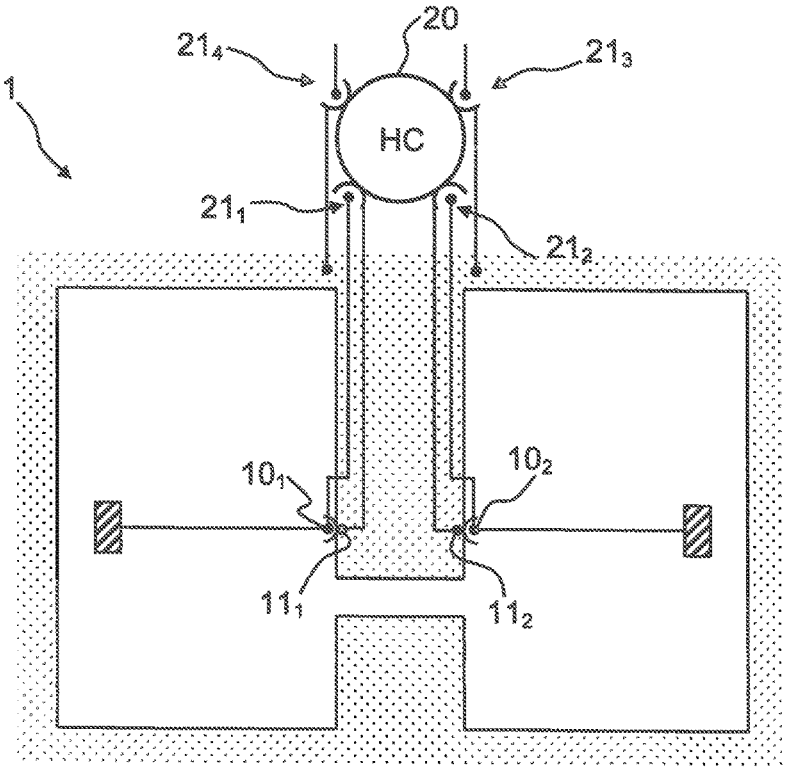
Figure 8:
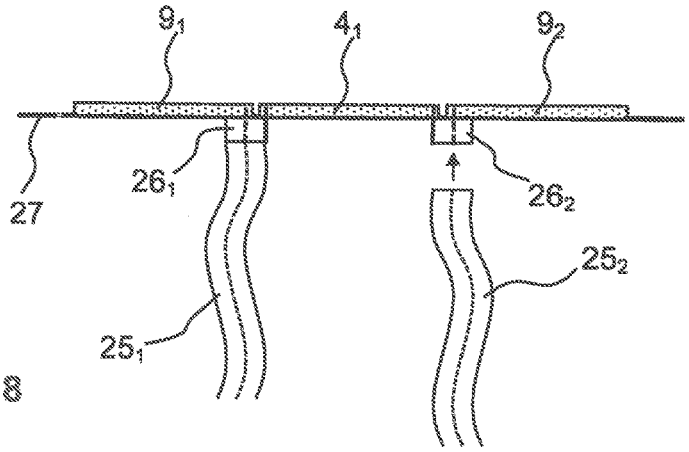
Figure 9:
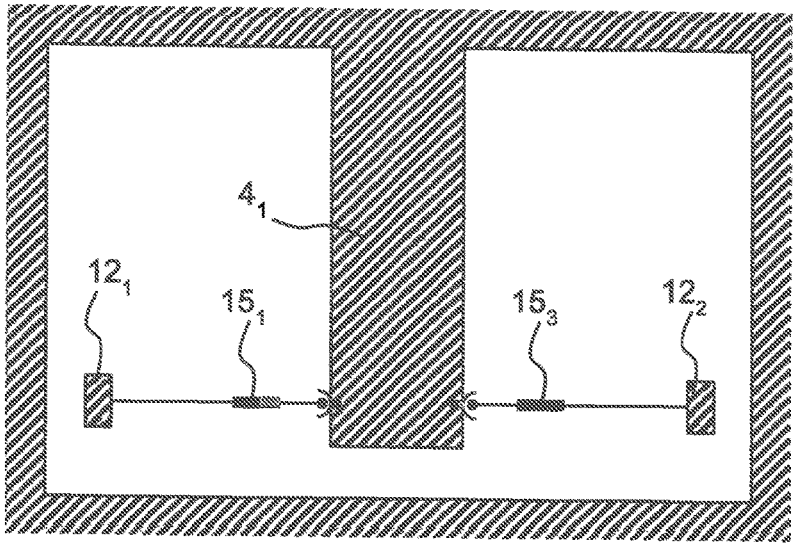
Figure 10:
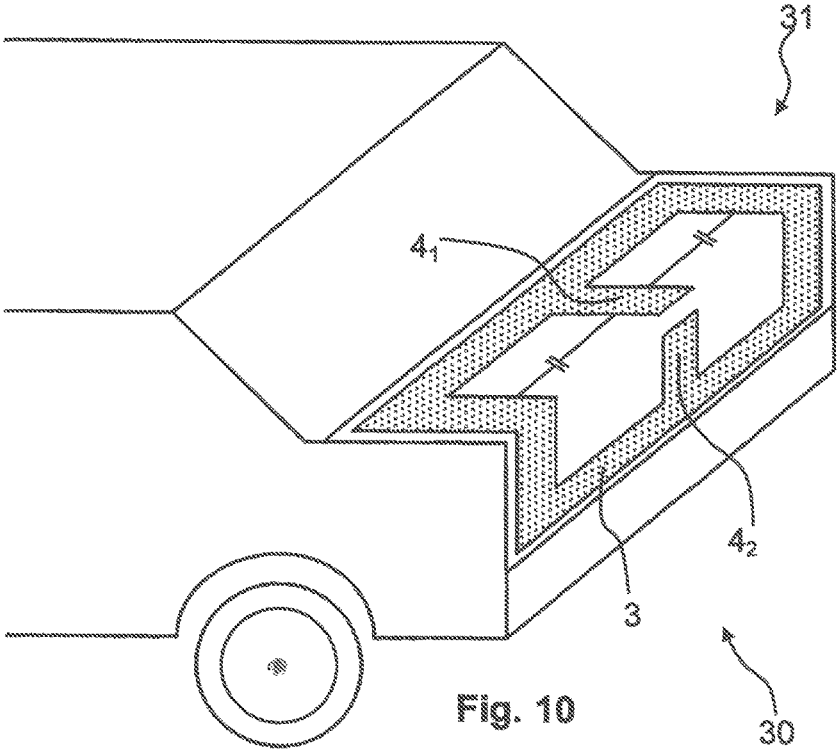

Various exemplary embodiments of the invention will be described as examples below with reference to the drawings. Identical elements have the same reference numerals. The various drawing figures show the following in detail:

FIG. 1: a plan view on one exemplary embodiment of the antenna system of the invention;

FIG. 2: a plan view on a further exemplary embodiment of the antenna system of the invention, with discrete capacitors;

FIG. 3: a plan view on a further exemplary embodiment of the antenna system of the invention showing the current distribution in the event of a symmetrical common-mode supply;

FIG. 4: a plan view on a further exemplary embodiment of the antenna system of the invention showing the current distribution for a symmetrical push-pull supply;

FIG. 5: a plan view on a further exemplary embodiment of the antenna system of the invention with additional inductances and further capacitors;

FIG. 6: a plan view on a further exemplary embodiment of the antenna system of the invention, with the first and second electrical line located at an angle other than 90° from the first crosspiece;

FIG. 7: a plan view on a further exemplary embodiment of the antenna system of the invention in which the supply is described by means of a 180° hybrid coupler as an example;

FIG. 8: a side view on a further exemplary embodiment of the antenna system of the invention, which clearly shows the connection of coaxial cables to the feed points and the ground terminal contacts;

FIG. 9: a plan view on a further exemplary embodiment of the antenna system of the invention e crosspiece; and FIG. 10: a three-dimensional view of a passenger car that has a trunk lid in which the antenna system of the invention is integrated.

FIG. 1 shows a plan view on an exemplary embodiment of the antenna system 1 of the invention. What is shown is a surface that comprises an electrically conductive medium. This electrically conductive medium can for instance comprise steel, copper, aluminum, brass or titanium, or combinations thereof. In principle, metals or metal alloys or conductive plastics, or plastics that are coated with a conductive film, and combinations thereof can be employed. This electrically conductive surface has a recess 2, as a result of which the electrically conductive surface represents a periphery 3 of the recess. FIG. 1 also shows two electrically conductive crosspieces $\mathbf{4}_1$, $\mathbf{4}_2$, which originate at two facing sides of the periphery 3 and are electrically conductively connected to it. The at least two electrically conductive crosspieces $\mathbf{4}_1$, $\mathbf{4}_2$ protrude into the recess 2, so that they extend toward one another and they end inside the recess 2, forming a gap 5 from one another. As a result, the recess 2 is divided into a first part $\mathbf{6}_1$, a second part $\mathbf{6}_2$, and the gap 5 connecting the two parts $\mathbf{6}_1$, $\mathbf{6}_2$. The crosspieces $\mathbf{4}_1$, $\mathbf{4}_2$ and the periphery 3 can be embodied in one piece or in two parts.

The periphery 3, in the exemplary embodiment of FIG. 1, is shown as a rectangular surface, which has a length L and a width B. The ratio of length L to width B should be selected such that it is approximately true that $L+B=\lambda/2$. Deviations from this, however, can be compensated for up to a certain amount. The wavelength $\lambda$ is preferably selected, especially for the application of FM radio reception in the automobile, that by means of the antenna system 1, the frequency range for USW (Ultra Shortwave) can be received in the range from approximately 87.5 MHz to approximately 108 MHz. With such tuning, it is also possible to receive UHF Band III, such as DAB (Digital Audio Broadcasting) or DMB (Digital Multimedia Broadcasting), the frequency range of which is approximately twice that of USW radio.

In FIG. 1, a plane of symmetry 7 and an axis 8 are also shown. The first crosspiece $\mathbf{4}_1$ and the second crosspiece $\mathbf{4}_2$ are located coaxially, with respect to their longitudinal axis, to the plane of symmetry 7. The first crosspiece $\mathbf{4}_1$ and the second crosspiece $\mathbf{4}_2$ furthermore share a longitudinal axis, which means that they are located coaxially to one another and face one another diametrically. The first crosspiece and the second crosspiece may, however, also be staggered relative to one another, in which case the term axial alignment is used.

It is also possible for the second crosspiece $\mathbf{4}_2$ not to be embodied, and for the first crosspiece $\mathbf{4}_1$ to extend almost to the periphery 3. The first crosspiece $\mathbf{4}_1$ protrudes into the recess 2 and extends in the direction of a second side, facing the first side, that is, the side where the first crosspiece $\mathbf{4}_1$ originates, of the periphery 3 and ends there, forming the gap 5 from the periphery. Then, the gap 5 is for instance located not in the middle or in other words the center of the recess 2 but rather closer to the periphery 3.

Two electrical lines $\mathbf{9}_1$, $\mathbf{9}_2$ are located inside the recess 2. A first electrical line $\mathbf{9}_1$ is located in the first part $\mathbf{6}_1$ of the recess 2, and a second electrical line $\mathbf{9}_2$ is located in the second part $\mathbf{6}_2$ of the recess 2. The first electrical line $\mathbf{9}_1$ in the first part $\mathbf{6}_1$ of the recess 2 originates or begins at a first feed point $\mathbf{10}_1$, which is located on the first crosspiece $\mathbf{4}_1$ but electrically separate from it. The second electrical line $\mathbf{9}_2$ originates or begins in the second part $\mathbf{6}_2$ of the recess 2, at a second feed point $\mathbf{10}_2$ that is located on the first crosspiece $\mathbf{4}_1$ but is electrically separate from it.

Both the first feed point $\mathbf{10}_1$ and the second feed point $\mathbf{10}_2$ should be located as close as possible to the first crosspiece $\mathbf{10}_1$. Preferably, the first feed point $\mathbf{10}_1$ and the second feed point $\mathbf{10}_2$ are located just close enough to close to the first crosspiece $\mathbf{4}_1$ that there is not yet an electrically conductive connection. Preferably, the first feed point and/or the second feed point is located less than $\lambda/5$, more preferably less than $\lambda/10$, more preferably less than $\lambda/15$, more preferably less than $\lambda/20$, more preferably less than $\lambda/50$, more preferably less than $\lambda/100$, more preferably less than $\lambda/500$ or more preferably less than $\lambda/1000$ of the highest frequency of the transmitted frequency band away from the first crosspiece $\mathbf{4}_1$.

A first ground terminal contact $\mathbf{11}_1$ is also shown, which is located on the first crosspiece $\mathbf{4}_1$ and is electrically connected to it. A second ground terminal contact $\mathbf{11}_2$ is likewise located on the first crosspiece $\mathbf{4}_1$ and electrically connected to it. The first ground terminal contact $\mathbf{11}_1$ is located as close as possible to the first feed point $\mathbf{10}_1$. The second ground terminal contact $\mathbf{11}_2$ is likewise located as close as possible to the second feed point $\mathbf{10}_2$.

As will be explained later in further detail with a look at FIG. 8, the first feed point feed point $\mathbf{10}_2$ can be electrically connected to the internal conductor of a first coaxial cable $\mathbf{25}_1$, and the first ground terminal contact $\mathbf{11}_1$ can be electrically connected to the outer conductor of the first coaxial cable $\mathbf{25}_1$. The same is true for the second feed point $\mathbf{10}_2$ with the second ground terminal contact $\mathbf{11}_2$ for a second coaxial cable $\mathbf{25}_2$. Preferably, however, a supply is made not by means of a coaxial line but via printed lines, which can for instance be microstrip lines or coplanar strip lines or strip lines or slot lines.

The first electrical line $\mathbf{9}_1$ extends, in the first part $\mathbf{6}_1$ of the recess, in the direction of the periphery 3 and is capacitively coupled by its end to the periphery. The term "end" of the first electrical line $\mathbf{9}_1$ should be understood to mean that part of the electrical line $\mathbf{9}_1$ which is the farthest away from the first feed point $\mathbf{10}_1$.

The same is true for the second electrical line $\mathbf{9}_2$, which in the second part of the recess, beginning at the second feed point $\mathbf{10}_2$, extends in the direction of the periphery 3 and is likewise capacitively coupled by its end to the periphery 3.

The first electrical line $\mathbf{9}_1$ and/or the second electrical line $\mathbf{9}_2$ extend orthogonally to the first crosspiece $\mathbf{4}_1$. In a further exemplary embodiment, not shown, it is also possible for the first electrical line $9_1$ and/or the second electrical line $9_2$ to extend orthogonally to the first crosspiece $4_1$ over more than 90% of their length, or more than 80% of their length, or more than 60% of their length.

The capacitive coupling of the end of the first electrical line $9_1$ and of the end of the second electrical line $9_2$ to the periphery 3, in the exemplary embodiment of FIG. 1, is effected via a distributed coupling capacitor $12_1$, $12_2$. The end of the first electrical line $9_1$ is electrically connected to a first distributed coupling capacitor $12_1$. The end of the second electrical line $9_2$ is likewise electrically connected to a second distributed coupling capacitor $12_2$. The distributed coupling capacitor $12_1$, $12_2$ are preferably a metal layer on a dielectric, on which preferably the first and/or second electrical line $9_1$, $9_2$ are also located. The distributed coupling capacitor $12_1$, $12_2$ can for instance be embodied as a layer of copper on a printed circuit board or foil. The shape of the distributed coupling capacitor $12_1$, $12_2$ can be designed arbitrarily. What is important is that the spacing and size of the distributed coupling capacitor $12_1$, $12_2$ with respect to the periphery 3 is selected such that the desired resonant frequency of the antenna system 1 is adjusted. It has been found empirically that a distributed coupling capacitor $12_1$, $12_2$ of approximately 1 pF to approximately 10 pF is desirable. The structure of the distributed coupling capacitor $12_1$, $12_2$, in the exemplary embodiment of FIG. 1, is rectangular. However, still other shapes are possible, such as rhombuses or triangles. It is also possible for a plurality of distributed coupling capacitors $12_1$, $12_2$ to be connected to the end of the first electrical line $9_1$ and the end of the second electrical line $9_2$. It would also be possible for a printed capacitor to be embodied on the electrical line $9_1$, $9_2$, between the distributed coupling capacitor $12_1$, $12_2$ and the periphery 3; the end of the electrical line $9_1$, $9_2$ is then connected to the periphery 3.

The first electrical line $9_1$ and of the end of the second electrical line $9_2$ preferably extend congruently to the axis 8; the axis 8 divides a side face of the antenna system 1, that is, divides the antenna system 1 with regard to its length L, in half in the middle. The axis 8 and the plane of symmetry 7 are preferably orthogonal to one another. The first electrical line $9_1$ is mirror-symmetrical to the second electrical line $9_2$, and the plane of symmetry 7 is the longitudinal axis of the first crosspiece $4_1$. The longitudinal axis of the first crosspiece $4_1$ and the longitudinal axis of the second crosspiece $4_2$, in this case, are congruent.

The length of the first crosspiece $4_1$ is greater than the length of the second crosspiece $4_2$. The length of a crosspiece $4_1$, $4_2$ is understood to be the spacing by which the corresponding crosspiece $4_1$, $4_2$ continues into the recess 2, beginning at the periphery 3. The width of the crosspiece $4_1$, $4_2$ is understood to be the measure for how far the corresponding crosspiece $4_1$, $4_2$ extends laterally, or in other words orthogonally to the length.

Preferably, the first crosspiece $4_1$ and the second crosspiece $4_2$ in terms of their dimensions are longer than they are wide. The length of the first crosspiece $4_1$ is greater than the width of first crosspiece $4_1$, and the length of the second crosspiece $4_2$ is greater than the width of the second crosspiece $4_2$. The first crosspiece $4_1$ and the second crosspiece $4_2$ are preferably equal in width. The width should be selected to be slight; it must be ensured that between the first crosspiece $4_1$ and the second crosspiece $4_2$, or if the second crosspiece $4_2$ is left out than between the first crosspiece $4_1$ and the second side of the periphery 3, a capacitance forms such that the corresponding resonant frequency is reached. If discrete capacitors 14 are also connected in between into the gap 5, then the width can also be even smaller. The width of the two crosspieces $4_1$, $4_2$ can vary, within the range from ⅓ the width of the periphery 3 to the smallest width that is still feasible when using a discrete capacitor 14.

However, it may also be that the first crosspiece $4_1$ is wider than or not as wide as the second crosspiece $4_2$.

In the exemplary embodiment of FIG. 1, the first part $6_1$ of the recess 2 and the second part $6_2$ of the recess 2 are of equal size. Preferably, the length of the first part $6_1$ is equal to the length of the second part $6_2$, and the width of the first part $6_1$ is preferably equivalent to the width of the second part $6_2$ of the recess 2.

However, it is also possible for the first part $6_1$ of the recess 2 to be larger than the second part $6_2$ of the recess 2. Conversely, it can naturally also be that the first part $6_1$ of the recess 2 is smaller than the second part $6_2$ of the recess 2.

The semicircles located around the first feed point $10_1$ and the second feed point $10_2$ are intended to indicate that both feed points $10_1$, $10_2$ and both ground terminal contacts $11_1$, $11_2$ can be supplied via coaxial cables $25_1$, $25_2$. However, the supply is preferably effected via printed lines, which may for instance be microstrip lines or coplanar strip lines or strip lines or slot lines.

FIG. 2 shows a plan view on a further exemplary embodiment of the antenna system 1 of the invention. In a distinction from the exemplary embodiment of FIG. 1, the end of the first electrical line $9_1$ and the end of the second electrical line $9_2$ is not connected to a distributed coupling capacitor $12_1$, $12_2$ but instead to a discrete capacitor $13_1$, $13_2$. In the present case, the end of the first electrical line $9_1$ is connected to the first discrete capacitor $13_1$, while conversely the end of the second electrical line $9_2$ is connected to the second discrete capacitor $13_2$. The first discrete capacitor $13_1$ is in turn electrically connected to the periphery 3. The same applies to the second discrete capacitor $13_2$, which is likewise electrically connected to the periphery 3. The discrete capacitors $13_1$, $13_2$ are preferably embodied as SMD (Service Mounted Device) components and are located on the same dielectric on which the first electrical line $9_1$ and/or the second electrical line $9_2$ is also mounted.

The discrete capacitors $13_1$, $13_2$ can also be implemented as tunable capacitors. Examples that can be considered are PIN diodes or diodes that can be connected by means of MEMS. When tunable capacitors are used, it is possible by means of a control signal for the capacitance on the first electrical line $9_1$ and the second electrical line $9_2$ to vary, or in other words to be tuned. The resonant frequency of the antenna system 1 can therefore be changed during operation, so that the antenna system 1 can be adapted to altered ambient conditions. For example, the antenna system 1 of the invention can be integrated into a trunk lid; it is then possible as a result of the tunable capacitor to compensate for a load in the trunk with electrically conductive and/or dielectric materials, so that the antenna system 1 of the invention continues to have the desired resonant frequency. For the discrete capacitor $13_1$, it is true—as it is for the distributed coupling capacitor $12_1$, $12_2$—that these are preferably mounted as close as possible to the periphery. The discrete capacitor $13_1$, $13_2$ is located less than $\lambda/5$, preferably less than $\lambda/10$, more preferably less than $\lambda/15$, more preferably less than $\lambda/20$, more preferably less than $\lambda/50$, more preferably less than $\lambda/100$, more preferably less than $\lambda/500$ or more preferably less than $\lambda/1000$ of the highest frequency of the transmitted frequency band away from the periphery 3 or from the corresponding feed point $10_1$, $10_2$.

Inside FIG. 2, a further discrete capacitor 14 is also embodied between the first crosspiece $\mathbf{4}_1$ and the second crosspiece $\mathbf{4}_2$. This further discrete capacitor 14 is embodied inside the gap 5 and connects the first crosspiece $\mathbf{4}_1$ to the second crosspiece $\mathbf{4}_2$. This likewise makes it possible to adapt the resonant frequency of the resonance mode, in common-mode excitation of the antenna system 1 of the invention. Instead of this further discrete capacitor 14, or in addition to this further discrete capacitor 14, at least one further discrete inductance can also be embodied inside the gap 5; it connects the first crosspiece $\mathbf{4}_1$ and the second crosspiece $\mathbf{4}_2$ to one another. In this way as well, the resonant frequency of the antenna system 1 can be adjusted.

FIG. 3 shows a plan view on a further exemplary embodiment of the antenna system 1 of the invention. Inside the exemplary embodiment of FIG. 3, a current distribution is shown as an example, with supply effected by using a symmetrical common-mode signal. The thicker the arrows shown are, the higher is the current density. The phase difference between the first feed point $\mathbf{10}_1$ and the second feed point $\mathbf{10}_2$ is 0°. The current density in the outer regions of the periphery is higher than in the first and second crosspieces $\mathbf{4}_1$, $\mathbf{4}_2$. The current density is highest at the point where the end of the first electrical line $\mathbf{9}_1$ and the end of the second electrical line $\mathbf{9}_2$ are capacitively coupled into the periphery 3. The discrete capacitor $\mathbf{13}_1$, $\mathbf{13}_2$ is a tunable capacitor. In the antenna system 1, the entire periphery is therefore used as an emitter, as a result of which the antenna system operates with a very broad band.

FIG. 4 shows a plan view on a further exemplary embodiment of the antenna system 1 of the invention. In this exemplary embodiment, current distribution with supply by a symmetrical push-pull signal is shown. The phase difference between the signal fed in at the first feed point $\mathbf{10}_1$ and the signal fed in at the second feed point $\mathbf{10}_2$ is 180°. Again, the thickness of the arrow corresponds to the current density. It can be seen that in the parts of the periphery 3 from which the crosspieces $\mathbf{4}_1$, $\mathbf{4}_2$ extend into the middle of the recess 2, the current density is the highest. Inside the crosspieces $\mathbf{4}_1$, $\mathbf{4}_2$, the current density is lowest, or no current flow takes place there. Beginning at the part of the periphery where the end of the first electrical line $\mathbf{9}_1$ and the end of the second electrical line $\mathbf{9}_2$ is capacitively coupled into it, the current density increases along the periphery up to the part of the periphery 3 where the crosspieces $\mathbf{4}_1$, $\mathbf{4}_2$ extend to the middle of the recess 2.

FIGS. 3 and 4 illustrate that with the antenna system 1 of the invention, two different resonance modes, which are preferably orthogonal to one another, can be excited. As a result, very highly de-correlated antennas are created, and thus very great antenna diversity is achieved.

FIG. 5 shows that inside the first electrical line $\mathbf{9}_1$, an inductance $\mathbf{15}_1$ is additionally integrated. Inside the second electrical line $\mathbf{9}_2$ as well, an inductance $\mathbf{15}_2$ is integrated. The inductances $\mathbf{15}_1$, $\mathbf{15}_2$ are preferably spaced apart from the corresponding feed point $\mathbf{10}_1$, $\mathbf{10}_2$ by a spacing of less than $\lambda/15$, more preferably less than $\lambda/20$, more preferably less than $\lambda/50$, more preferably less than $\lambda/100$, more preferably less than $\lambda/500$ or more preferably less than $\lambda/1000$ of the highest frequency of the transmitted frequency band.

Between the first crosspiece $\mathbf{4}_1$ and the second crosspiece $\mathbf{4}_2$, a further discrete capacitor 14, in the form of a tunable capacitance is embodied. Other capacitors of variable size can also be used. The additional capacitors and inductances have the effect that even with smaller spatial dimensions for the length and width of the antenna system 1 of the invention, the desired resonant frequency can reliably be achieved.

FIG. 6 shows a plan view on a further exemplary embodiment of the antenna system 1 of the invention. The first electrical line $\mathbf{9}_1$ and the second electrical line $\mathbf{9}_2$ are located at an angle other than 0° from the first crosspiece $\mathbf{4}_1$. The first electrical line $\mathbf{9}_1$ and/or the second electrical line $\mathbf{9}_2$ forms an angle $\alpha$ with the first crosspiece $\mathbf{4}_1$ that is between 60° and 120°, preferably between 70° and 110°, more preferably between 80° and 100°, and more preferably between 85° and 95°. The angle that the first electrical line $\mathbf{9}_1$ forms with the crosspiece $\mathbf{4}_1$ is intended to be equivalent to the angle that the second electrical line $\mathbf{9}_2$ forms with the crosspiece $\mathbf{4}_2$.

FIG. 7 shows a plan view on a further exemplary embodiment of the antenna system 1 of the invention, in which the supply is described by way of example by a feeder device 20, which is preferably embodied in the form of a 180° hybrid coupler 20. The 180° hybrid coupler 20 shown has four gates $\mathbf{21}_1$, $\mathbf{21}_2$, $\mathbf{21}_3$, $\mathbf{21}_4$. The gates $\mathbf{21}_1$, $\mathbf{21}_2$, $\mathbf{21}_3$, $\mathbf{21}_4$ are preferably provided with a coaxial terminal. A connection by means of printed lines is likewise possible.

A first gate $\mathbf{21}_1$ has an inner conductor and an outer conductor. The inner conductor of the first gate $\mathbf{21}_1$ of the 180° hybrid coupler 20 is preferably electrically connected to the first feed point $\mathbf{10}_1$ via a first coaxial cable $\mathbf{25}_1$. The outer conductor of the first gate $\mathbf{21}_1$ of the 180° hybrid coupler 20 is preferably likewise connected via a coaxial cable to the first ground terminal contact $\mathbf{11}_1$.

A second gate $\mathbf{21}_2$ has an inner conductor and an outer conductor. The inner conductor of the second gate $\mathbf{21}_2$ of the 180° hybrid coupler 20 is preferably electrically connected to the second feed point $\mathbf{10}_2$ via a second coaxial cable $\mathbf{25}_2$. The outer conductor of the second gate $\mathbf{21}_2$ of the 180° hybrid coupler 20 is likewise connected via the second coaxial cable $\mathbf{25}_2$ to the second ground terminal contact $\mathbf{11}_2$.

Moreover, the 180° hybrid coupler 20 also has a third and a fourth gate $\mathbf{21}_3$, $\mathbf{21}_4$, which can be connected for instance to a respective amplifier, or a plurality of amplifiers and/or a tuner, none of which are shown. The outer conductor of the third and fourth gates $\mathbf{21}_3$, $\mathbf{21}_4$ are electrically conductively connected to the periphery 3. Preferably, they are contacted electrically conductively to the first crosspiece $\mathbf{4}_1$.

The 180° hybrid coupler 20 can output a symmetrical common-mode signal and a symmetrical push-pull signal to the first feed point $\mathbf{10}_1$ and the second feed points $\mathbf{10}_2$, or can receive such signals from them.

The use of an HF transformer, which can also be used for supply, is not shown. The push-pull mode is supplied on the primary side of the HF transformer; the common mode is supplied at the center tap on the secondary side. The two other terminals on the secondary side are then connected to the feed points $\mathbf{10}_1$, $\mathbf{10}_2$. An HF transformer makes an impedance transformation possible, in order to improve the adaptation of the antenna impedance.

FIG. 8 shows a side view of an exemplary embodiment of the antenna system 1 of the invention, which illustrates the connection of coaxial cables $\mathbf{25}_1$, $\mathbf{25}_2$ to the feed points $\mathbf{10}_1$, $\mathbf{10}_2$ and the ground terminal contacts $\mathbf{11}_1$, $\mathbf{11}_2$. A first coaxial cable $\mathbf{25}_1$, via a first terminal connection $\mathbf{26}_1$, contacts the first feed point $\mathbf{10}_1$ and the first ground terminal contact $\mathbf{11}_1$. A second coaxial cable $\mathbf{25}_2$, via a second terminal connection $\mathbf{26}_2$, contacts the second feed point $\mathbf{10}_2$ and the second ground terminal contact $\mathbf{11}_2$. The first electrical line $\mathbf{9}_1$, in the exemplary embodiment shown, is embodied on a dielectric 27. The second electrical line $\mathbf{9}_2$ is likewise embodied on the dielectric medium 27. The first electrical line $\mathbf{9}_1$ and the second electrical line $\mathbf{9}_2$ can be embodied on the same or a different dielectric medium 27. In the exemplary embodiment shown, the first crosspiece $\mathbf{4}_1$ is likewise embodied on the dielectric medium 27. However, the first crosspiece $\mathbf{4}_1$, like the second crosspiece $\mathbf{4}_2$ and the periphery 3, can also make do without any further fixed underlay. The crosspieces $\mathbf{4}_1$, $\mathbf{4}_2$ may also comprise any other conductive material, without the use of a dielectric substrate material. The first terminal connection $\mathbf{26}_1$ and the second terminal connection $\mathbf{26}_2$ are preferably a coaxial bushing. It can be seen that the inner conductor of the first coaxial cable $\mathbf{25}_1$ is electrically connected to the first electrical line $\mathbf{9}_1$, while conversely the outer conductor of the first coaxial cable $\mathbf{25}_1$ is electrically conductively connected to the first crosspiece $\mathbf{4}_1$. The same is true for the second coaxial cable $\mathbf{25}_1$ as well. Its inner conductor is electrically conductively connected to the second electrical line $\mathbf{9}_2$. Its outer conductor is electrically conductively connected to the first crosspiece $\mathbf{4}_1$. The first feed point $\mathbf{10}_1$ and the second feed point $\mathbf{10}_2$ may be so-called VIAs (for Vertical Interconnect Access), which the first terminal connection $\mathbf{26}_1$ and the second terminal connection $\mathbf{26}_2$ engage and are soldered into. The coaxial cables $\mathbf{25}_1$, $\mathbf{25}_2$ are furnished from the opposite side of the dielectric medium 27 of the terminal connection $\mathbf{26}_1$ from where the electrical lines $\mathbf{9}_1$, $\mathbf{9}_2$ are located.

The feed points $\mathbf{10}_1$, $\mathbf{10}_2$ and the ground terminal contacts $\mathbf{11}_1$, $\mathbf{11}_2$ may also be supplied via printed lines in the form of microstrip lines or coplanar strip lines or strip lines or slot lines.

FIG. 9 shows a plan view on a further exemplary embodiment of the antenna system 1 of the invention. In contrast to the previous exemplary embodiments, the exemplary embodiment of FIG. 9 has no second crosspiece $\mathbf{4}_2$. The first electrically conductive crosspiece $\mathbf{4}_1$ originates, or in other words begins, at the first side of the periphery 3 and is electrically conductively connected to this first side and thus to the periphery 3. The first crosspiece $\mathbf{4}_1$ protrudes into the recess 2 and extends in the direction of a second side of the periphery 3, facing the first side, and ends there, forming the gap 5 with the periphery. As a result, the recess 2 is divided into the first part $\mathbf{6}_1$ and a second part $\mathbf{6}_2$ and the gap 5 connecting the two parts $\mathbf{6}_1$, $\mathbf{6}_2$. The location shown in FIG. 9 for the first crosspiece $\mathbf{4}_1$ can be the same in the other exemplary embodiments in the other drawings as well.

FIG. 10 shows a three-dimensional view of a passenger car 30, which has a trunk lid 31; the antenna system 1 of the invention is integrated inside the trunk lid 31. It can be seen that the first crosspiece $\mathbf{4}_1$ is located in a first plane and that the second crosspiece $\mathbf{4}_2$ is located in a second plane; the two ends meet one another at an angle of preferably 90°. The two planes may also meet at an angle of 80° to 280°, preferably 80° to 200°, more preferably 85° to 150°, more preferably 85° to 120°, more preferably 85° to 95°. The first crosspiece $\mathbf{4}_1$ is preferably located approximately parallel to the surface of the roadway the passenger car 30 is traveling on. However, the first crosspiece $\mathbf{4}_1$ may also be inclined to the roadway surface by less than 15°, preferably less than 10°, more preferably less than 5°.

The trunk lid 31 is formed of a dielectric material in the vicinity of the recess 2. A dielectric material can for example cover the antenna system 1 in the vicinity of the recess 2. Such an antenna system 1 integrated with a trunk lid 31 has multiple times better properties with regard to the antenna diversity compared to a conventional antenna system that is integrated into the rear window of the passenger car 30.

By means of the antenna system 1 of the invention, at least two orthogonal resonance modes can be excited, the radiation diagrams of which are highly different and thus supplement one another very well, which leads to very good de-correlation of them. Thus a two-antenna diversity system can be implemented with very good insulation in little space. The antenna system 1 may also be used as a multiband antenna, as long as the higher bands are each harmonics of the first band.

The load-bearing structures of the trunk lid 31 comprise conductive material, while the planking is done with non-conductive material, that is, a dielectric. As a result, the entire trunk lid 31 can be excited, so that by means of the large mechanical dimensions of the trunk lid 31 relative to the USW wavelength, broadband emission can be implemented.

The length of the gap 5 is less than 10%, preferably less than 20%, more preferably less than 30% of the total length of the first crosspiece $\mathbf{4}_1$ or second crosspiece $\mathbf{4}_2$. The length must be selected always such that the desired resonant frequency is established. If the requisite capacitance for this purpose with the gap 5 cannot alone be achieved, then an adaptation can be made using discrete components.

The invention is not limited to the exemplary embodiments described. Within the scope of the invention, all the features described and/or shown can be combined arbitrarily with one another.

The invention claimed is:

1. An antenna system comprising:

an electrically conductive surface that comprises an electrically conductive medium;

a recess that is located inside the electrically conductive surface, as a result of which the electrically conductive surface acts as a periphery of the recess;

at least one first electrically conductive crosspiece, which originates on a first side of the periphery and is electrically conductively connected to the periphery and protrudes into the recess and extends in the direction of a second side, facing the first side, of the periphery and there ends with the periphery, forming a gap, as a result of which the recess is divided into a first part and a second part and the gap that connects the two parts;

at least two electrical lines, of which a first electrical line originates in the first part of the recess at a first feed point, located at or near the first crosspiece but electrically separate from it, and a second electrical line originates in the second part of the recess at a second feed point located at or near the first crosspiece but electrically separate from it;

the first electrical line extends in the first part of the recess in the direction of the periphery and is capacitively coupled to the periphery, and the second electrical line extends in the second part of the recess in the direction of the periphery and is capacitively coupled to the periphery, wherein the first feed point is connectable to or connected to a first gate of a feeder device, and the second feed point is connectable to or connected to a second gate of a feeder device, and the feeder device supplies a first feed point and the second feed point with a common-mode signal and/or a push-pull signal.

2. The antenna system of claim 1, further comprising at least one second electrically conductive crosspiece, which originates at the second side of the periphery and is connected electrically conductively to the periphery and protrudes into the recess and inside tapers to a point toward the first crosspiece, and both crosspieces end there, forming the gap from one another.

3. The antenna system of claim 2, wherein the at least two crosspieces are of equal length.

4. The antenna system of claim 1, wherein the feeder device comprises at least one of (a) a hybrid coupler, (b) a 180° hybrid coupler, and (c) an HF transformer.

5. The antenna system of claim 1, wherein the first feed point is electrically connectable or connected to an inner conductor of a first coaxial cable or a conductor of a first printed line, and/or the second feed point is electrically connectable or connected to an inner conductor of a second coaxial cable or a conductor of a second printed line.

6. The antenna system of claim 5, wherein an outer conductor of the first coaxial cable or a ground face of the first printed line is electrically connectable or connected to the first crosspiece via a first ground terminal contact on the first crosspiece, and/or an outer conductor of the second coaxial cable or a ground face of the second printed line is electrically connectable or connected to the second crosspiece via a second ground terminal contact on the second crosspiece.

7. The antenna system of claim 6, wherein the spacing between the first feed point and the first ground terminal contact is less than λ/100 or less than λ/500 or less than λ/1000 of the highest frequency of the transmitted frequency band, and/or the spacing between the second feed point and the second ground terminal contact is less than λ/100 or less than λ/500 or less than λ/1000 of the highest frequency of the transmitted frequency band.

8. The antenna system of claim 1, wherein the first feed point and/or the second feed point is located less than λ/5 or less than λ/10 or less than λ/15 or less than λ/20 or less than λ/50 or less than λ/100 or less than λ/500 or less than λ/1000 of the highest frequency of the transmitted frequency band away from the gap.

9. The antenna system of claim 1, wherein the first part of the recess and the second part of the recess are of equal size, or the first part of the recess is larger than the second part of the recess, or the first part of the recess is smaller than the second part of the recess.

10. The antenna system of claim 1, wherein the first electrical line, via its end, and the second electrical line, via its end, are capacitively coupled to the periphery by a distributed coupling capacitor and/or a discrete capacitor.

11. The antenna system of claim 10, wherein the distributed coupling capacitor and/or the discrete capacitor is located less than λ/10 or less than λ/15 or less than λ/20 or less than λ/50 or less than λ/100 or less than λ/500 or less than λ/1000 of the highest frequency of the transmitted frequency band from the periphery.

12. The antenna system of claim 10, wherein the discrete capacitor is a capacitor or a variable-frequency capacitor and/or the capacitor or the variable-frequency capacitor is variable in its value.

13. The antenna system of claim 1, further comprising at least one discrete inductance embodied in the first electrical line and/or in the second electrical line.

14. The antenna system of claim 2, wherein the first crosspiece is connected to the second crosspiece or to the second side of the periphery via at least one further discrete capacitor and/or with one another via at least one further discrete inductance, and the at least one further discrete capacitor and/or the at least one further discrete inductance is embodied inside the gap.

15. The antenna system of claim 1, wherein the first electrical line and/or the second electrical line extends orthogonally to the first crosspiece, or the first electrical line and/or the second electrical line are at an angle from the first crosspiece that is between 60° and 120°, between 70° and 110°, or between 80° and 100°.

16. The antenna system of claim 1, wherein the first electrical line is mirror-symmetrical to the second electrical line, and the plane of symmetry is the longitudinal axis of the first crosspiece.

17. The antenna system of claim 1, wherein the first electrical line and/or the second electrical line is formed as a conductor track on a dielectric, or the first electrical line and/or the second electrical line is embodied as a cable or wire.

18. The antenna system of claim 1, wherein the first crosspiece is located in a first plane, and the second crosspiece or the second side of the periphery is located in a second plane, and the two planes meet one another at an angle of 80° to 280°, 80° to 200°, 85° to 150°, 85° to 120°, or 85° to 95°.

19. A trunk lid having an antenna system of claim 1, wherein the trunk lid, in the vicinity of the recess, comprises a dielectric material or can be lined with dielectric material.

20. A passenger car having a trunk lid of claim 19, wherein the first crosspiece is located approximately parallel to the surface of the roadway, or the first crosspiece is tilted by less than 5° or less than 10° or less than 15° relative to the surface of the roadway.

21. The antenna system of claim 2 wherein the first crosspiece is longer than the second crosspiece.

22. The antenna system of claim 2 wherein the second crosspiece is longer than the first crosspiece.

23. An antenna comprising:

an electrically conductive surface defining a recess having a periphery, the electrically conductive surface comprising the periphery of the recess;

at least one electrically conductive crosspiece electrically connected to the electrically conductive surface, the at least one crosspiece protruding into the recess to divide the recess into parts with a gap connecting the parts, the crosspiece having first and second feedpoints located thereon;

at least one electrical line disposed in a part of the recess at the first feedpoint disposed at or near the crosspiece but electrically separate from the first feedpoint, the electrical line extending in the part of the recess in the direction of the periphery and being capacitively coupled to the periphery; and a feeder configured to supply the first feed point and the second feed point with a common-mode signal and/or a push-pull signal, the feeder comprising (a) a first gate connectable to or connected to the first feedpoint, and (b) a second gate connectable to or connected to the second feed point.

* * * * *